US006138565A

United States Patent [19]

Koch et al.

[11] Patent Number: 6,138,565

[45] Date of Patent: Oct. 31, 2000

[54] METHOD AND APPARATUS FOR GUIDING SHEETS ON A GUIDE BLADE IN PRINTING MACHINES

[75] Inventors: Michael Koch, Cossebaude; Günter Lucius, Dresden, both of Germany

[73] Assignee: Koenig & Bauer AG, Germany

[21] Appl. No.: 09/277,392

[22] Filed: Mar. 26, 1999

[30] Foreign Application Priority Data

Mar. 28, 1998 [DE] Germany ..... 198 14 006

[51] Int. Cl.[7] ..... B41F 1/28

[52] U.S. Cl. ..... 101/420; 271/195; 101/416.1; 101/246

[58] Field of Search ..... 101/231, 232, 101/216, 217, 419, 420, 421, 416.1; 271/195, 276, 309, 310

[56] References Cited

U.S. PATENT DOCUMENTS 5,411,251 5/1995 Schmid et al. ..... 271/195
5,836,247 11/1998 Stephan et al. ..... 101/420
5,868,386 2/1999 Stiel et al. ..... 271/195
5,941,520 8/1999 Stephan et al. ..... 271/195

*Primary Examiner*—Christopher A. Bennett
*Attorney, Agent, or Firm*—Schweitzer Cornman Gross & Bondell LLP

[57] ABSTRACT

A guide blade for guiding sheets in a printing machine in in-line or perfecting mode processes employing trailing edge turning, the guide blade has a front edge and an end piece, and air nozzels located in a flow surface extending from the front edge along the end piece. The air nozzels are connected to a source of pressurized gas, and direct pressurized gas in the direction of travel of the sheets. A plurality of parallel, spaced-apart, guiding fins project downwardly from the flow surface. The guiding fins have downstream ends which are spaced further away from the flow surface than the upstream ends thereof. The sheet, along with the guiding fins and the flow surface, create a diverging flow channel below the end piece of the guide blade, inducing a partial vacuum in the flow channel, which maintains the sheet in contact with said guide blade. The guide fins include air nozzels and the angle between the guiding fins and the flow surface can be adjusted. Further, using a thread bolt, the lateral width covered by the guide blades can be adjusted to accomodate various width sheets.

9 Claims, 6 Drawing Sheets

METHOD AND APPARATUS FOR GUIDING SHEETS ON A GUIDE BLADE IN PRINTING MACHINES

FIELD OF INVENTION

The invention relates to pneumatic sheet guiding on a guide blade in printing machines, and in particular, to pneumatic sheet guiding for in-line mode or in perfecting mode printing processes, whereby the sheet is turned by its trailing edge.

BACKGROUND OF INVENTION

The sheet turning process in printing machines with a perfecting process starts in the perfecting mode—as known in the arts—with the separation of the sheet front edge from the surface of the cylinder preceding the perfecting drum. A lifting mechanism in the cylinder lifts the front edge of the sheet over the prongs of a guide blade which strip the sheet from the cylinder and guide the sheet with pneumatic support along the cylinder contour until the rear end of the sheet is grasped by a sheet holding element (sucker system). Subsequently, the sheet undergoes return of its motion. The pneumatic guiding force for the sheet is produced by a negative pressure and tangential force created by a blow-suction effect. Such guide blades are known from DE 44 24 964 A1 and DE 196 35 388 A1.

With known devices, the front section of the sheet to be turned glides relatively evenly over the guiding surface of the guide blade. However, sheet fluttering can occur when the sheet approaches the return motion. The front part of the sheet, especially the sheet corners can flutter heavily and thus can negatively influencing the sheet guiding and the printing image (smearing). The reason for sheet fluttering in this relevant area is the fluctuating pressure on the sheet depending on the position of the sheet and also a deformation of the sheet itself. This is caused by the growing length and area of the sheet guiding on an air cushion, and the short dwell time during the return motion when the gap between the sheet and guiding surface is open from the back, which opening causes the negative pressure to degrade.

SUMMARY DESCRIPTION OF INVENTION

It is an object of the present invention to provide a device for guiding sheets on a guide blade without sheet fluttering especially before and after its return motion.

The problems of the prior art are solved by the present invention, in that when the sheet passes the tangential point of the perfecting drum and the preceding cylinder, the front edge of the sheet is lifted by a guide blade and moved along the guiding area of the guide blade tip with the support of pressurized air flowing in the direction of the moving sheet. The sheet is further transported in a horizontal direction on guiding fins to the end piece of the guide blade. The guide fins form part of a flow channel which diverges in the flow direction of the pressurized air. The flow channel acts as a diffuser and has a permanent negative pressure which results in a smooth sheet travel.

The formation of the flow channel results from the existence of mechanical guiding fins extending between the sheet and a lower sheet metal plate of the guide blade. The guiding fins are arranged at an angle $\alpha$ with respect to the lower sheet metal plate and form a flow channel with a continuously increasing cross section in the flow direction. During the perfecting process, the guiding fins guide the sheet away from the lower sheet metal plate. Thus, the sheet itself is thereby part of the flow channel.

It is necessary to reach a balance of the frictional force between the sheet and the guiding fins created by the negative pressure and the ability to thrust the sheets, especially unstable sheets. The present invention achieves this balance in that the blow air from the slot nozzles of the guiding fins both supports the sheet during travel and creates a friction-reducing airfoil for the sheet in the area of the guiding fins.

BRIEF DESCRIPTION OF DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
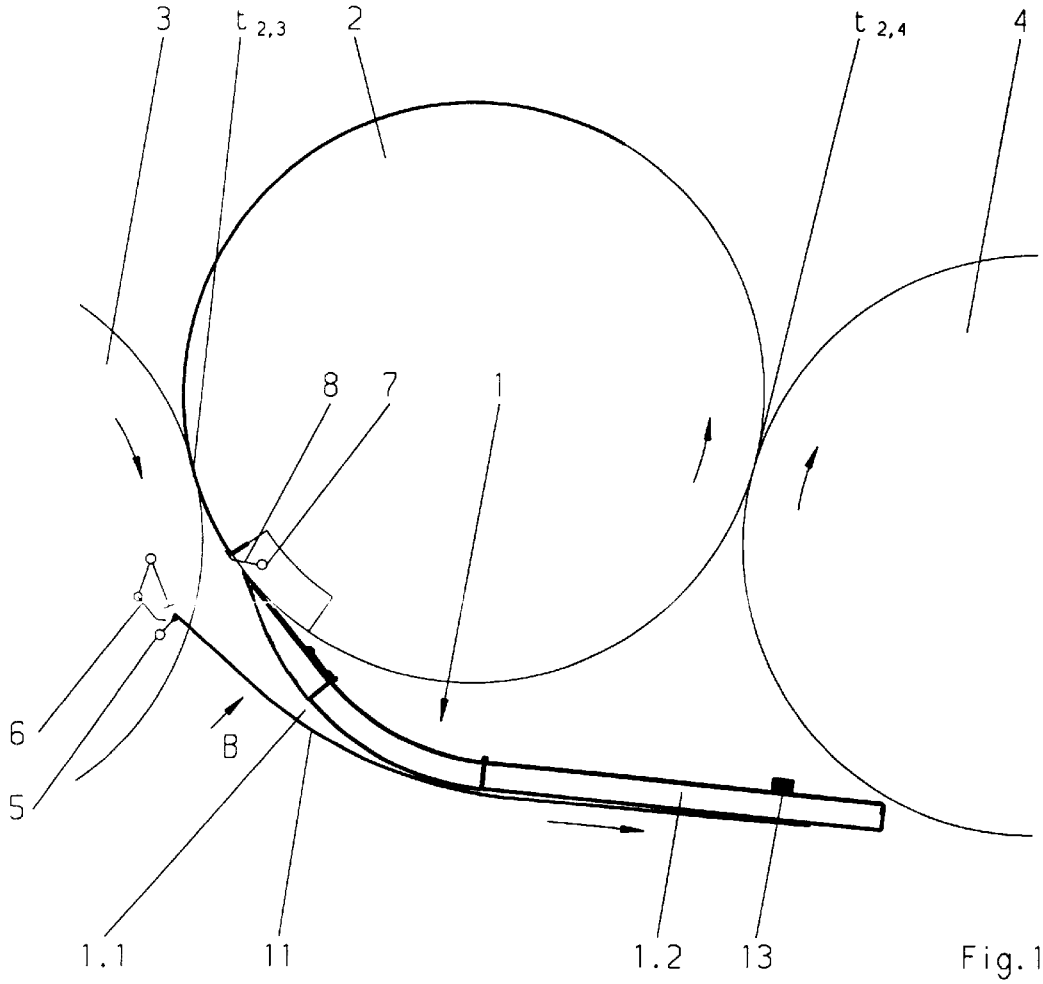
FIG. 1 is a schematic side elevational view of a first embodiment of the guide blade of the present invention.

FIG. 1 shows the schematic arrangement of the guide blade 1 to the cylinder 2, which is preceded by a perfecting drum 3.

The cylinder 2 can be an impression cylinder 2. It is however also possible to use the guide blade 1 in conjunction with a storage drum 2, which is thereupon preceded by a perfecting drum 3. A transfer drum 4 precedes the impression cylinder 2 and meets the impression cylinder 2 at the common tangential point $t_{2,4}$. The perfecting drum 3 and the impression cylinder 2 meet at the common tangential point $t_{2,3}$.

The perfecting drum 3 can carry, as well known for example from DD-PS 54 703, two diametrical opposing sucker systems 5 and gripper systems 6.

The rotational directions of the cylinders, respectively drums 2, 3, 4, are marked with arrows. The impression cylinder 2 is shown with gripper shaft 7 and gripper 8. The guide blade 1 is located underneath the impression cylinder 2 and extends over the width of impression cylinder 2 and transfer drum 4.

The guide blade 1 extends in the lengthwise direction of the printing machine beyond the tangential point $t_{2,4}$ between impression cylinder 2 and transfer drum 4. The moving direction of the sheet 11 in the initial phase for the method is shown with an arrow.

Figure 3:
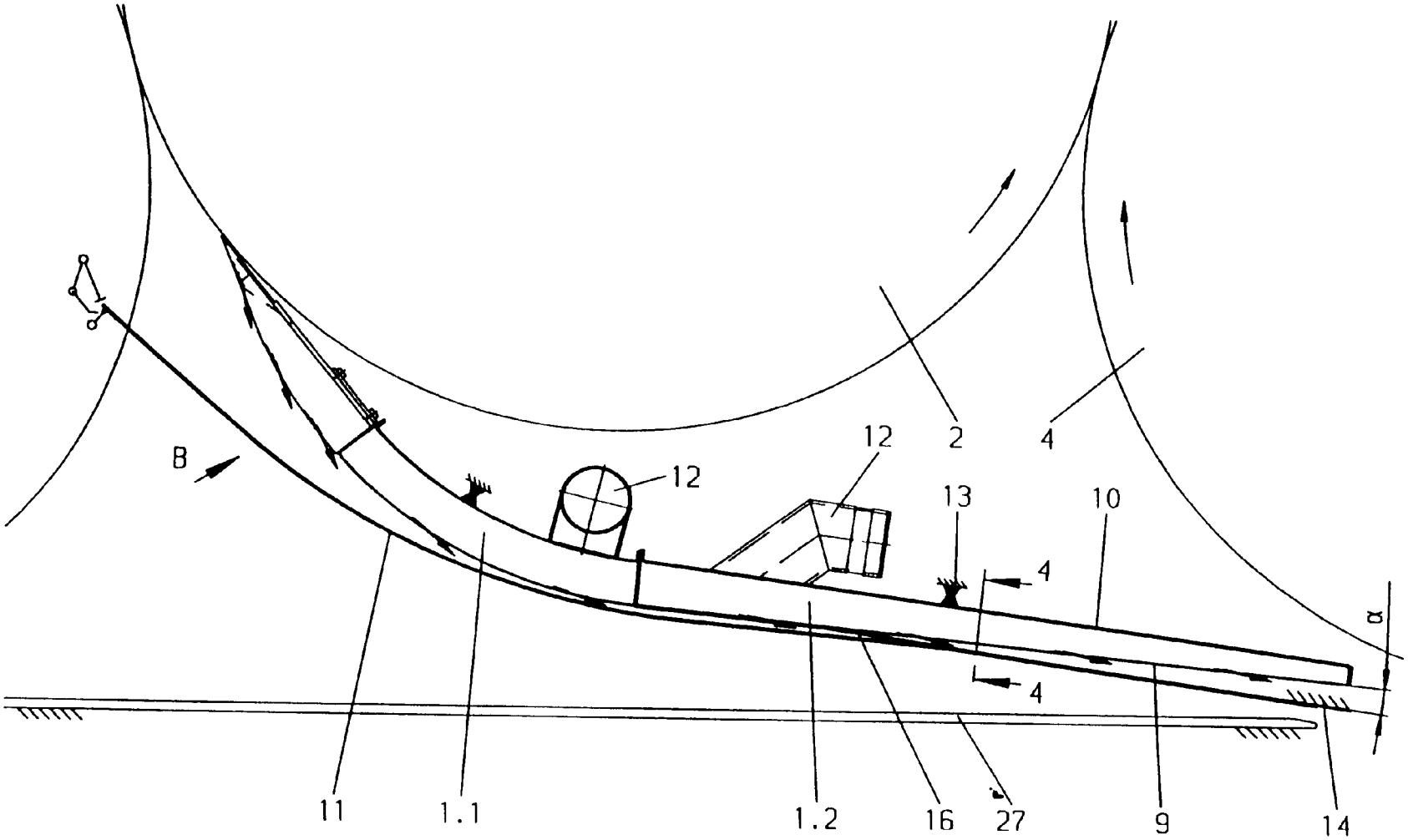
FIG. 3 is an enlarged side elevational view of the guide blade of FIG. 1.

Underneath the guide blade 1 is the sheet guiding equipment 27 reaching over the width of the printing machine (FIG. 3).

FIG. 3 shows the side view of the detailed structure of the guide blade 1 according the first embodiment. A crossbar 13 to the machine frame 14 mounts the guide blade 1. The guide blade 1 consists of a guide blade tip 1.1 and an end piece 1.2 which form one functional unit.

Figure 2:
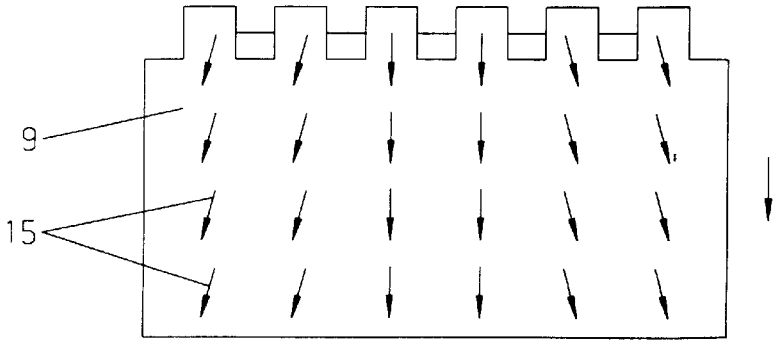
FIG. 2 is a bottom plan view of the guide blade tips, taken along line B—B of FIG. 1.

The guide blade tip 1.1 points to the impression cylinder 2. The front range of the guide blade tip 1.1 is shaped like a comb in order to enable the passage of the grippers 8 of the impression cylinder 2 (FIG. 2). This is state of the art also for the entire configuration of the guide blade tip 1.1 and is the same for both embodiments of the end piece 1.2 (FIG. 3 to FIG. 7).

The guide blade tip 1.1 is curved and the end piece 1.2 is preferably straight (though, this is not required). The guide blade tip 1.1 has an upper sheet metal plate 10 with an air supply 12 and a lower sheet metal plate 9. The lower sheet metal plate 9 forms a flow surface and a guiding surface 9 for the sheet 11, and is located on the opposite side of the impression cylinder 2, as seen in FIG. 2. The lower sheet metal plate 9 and upper sheet metal plate 10 are laterally connected with side panels.

The lower sheet metal plate 9 carries slot nozzles 15 through which air is directed in the travel direction of the sheet 11. The outlet angle of the slot nozzles 15 is small, so that the air jets spreads between sheet 11 and the lower sheet metal plate 9.

Figure 4:
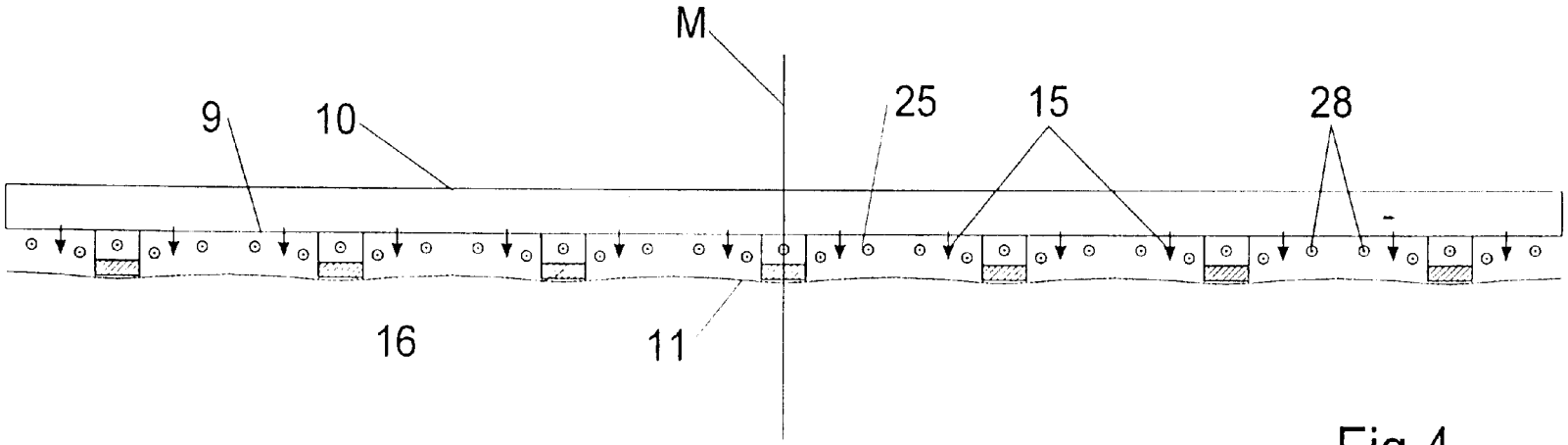
FIG. 4 is a cross-sectional elevation view, taken along the line A—A of FIG. 3.

Referring to FIGS. 3 and 4, the end piece 1.2 includes the upper sheet metal plate 10 and the lower sheet metal plate 9, which lower sheet metal plate 9 has slot nozzles 15. The lower sheet metal plate 9 has parallel spaced guiding fins 16, which extend downwardly from the lower sheet metal plate 9, and extend along a substantial length of the flow surface. The distance of these guiding fins 16 to the lower sheet metal plate 9 increases continuously in the flow direction of the air, so that the cross section of the flow channel 25, formed between the lower sheet metal plate 9 and the sheet 11, grows in the same direction. That is, the downstream ends of the guide fins are spaced further apart from the lower sheet metal plate 9 (and from the flow surface formed thereby) than the upstream ends thereof.

Figure 6:
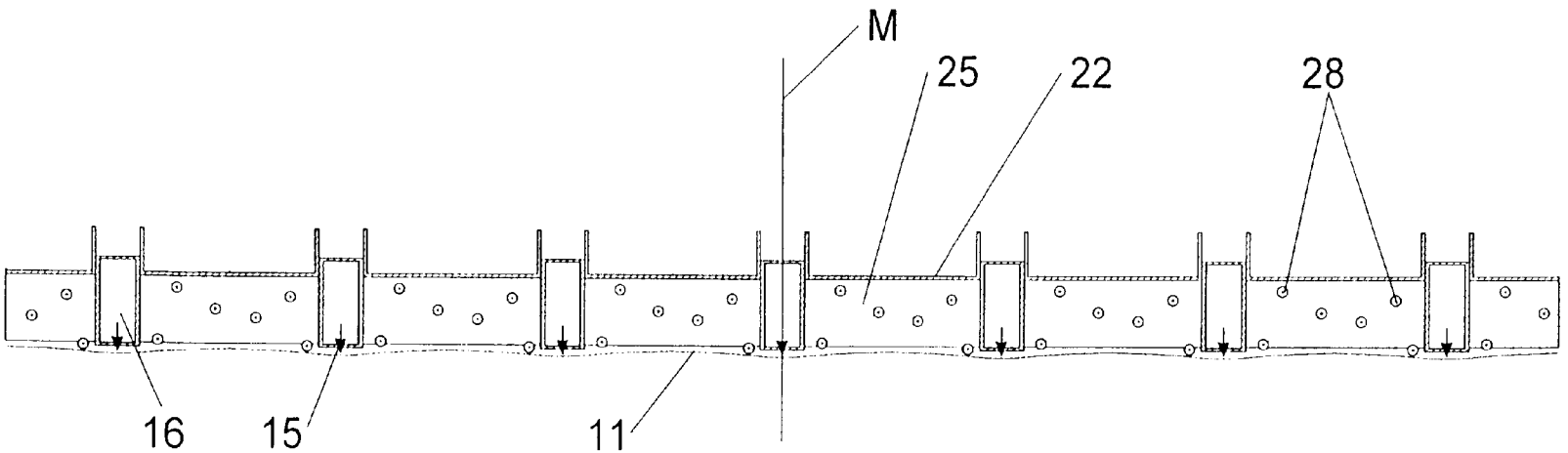
FIG. 6 is a cross-sectional elevation view, taken along line C—C of FIG. 5.
Figure 5:
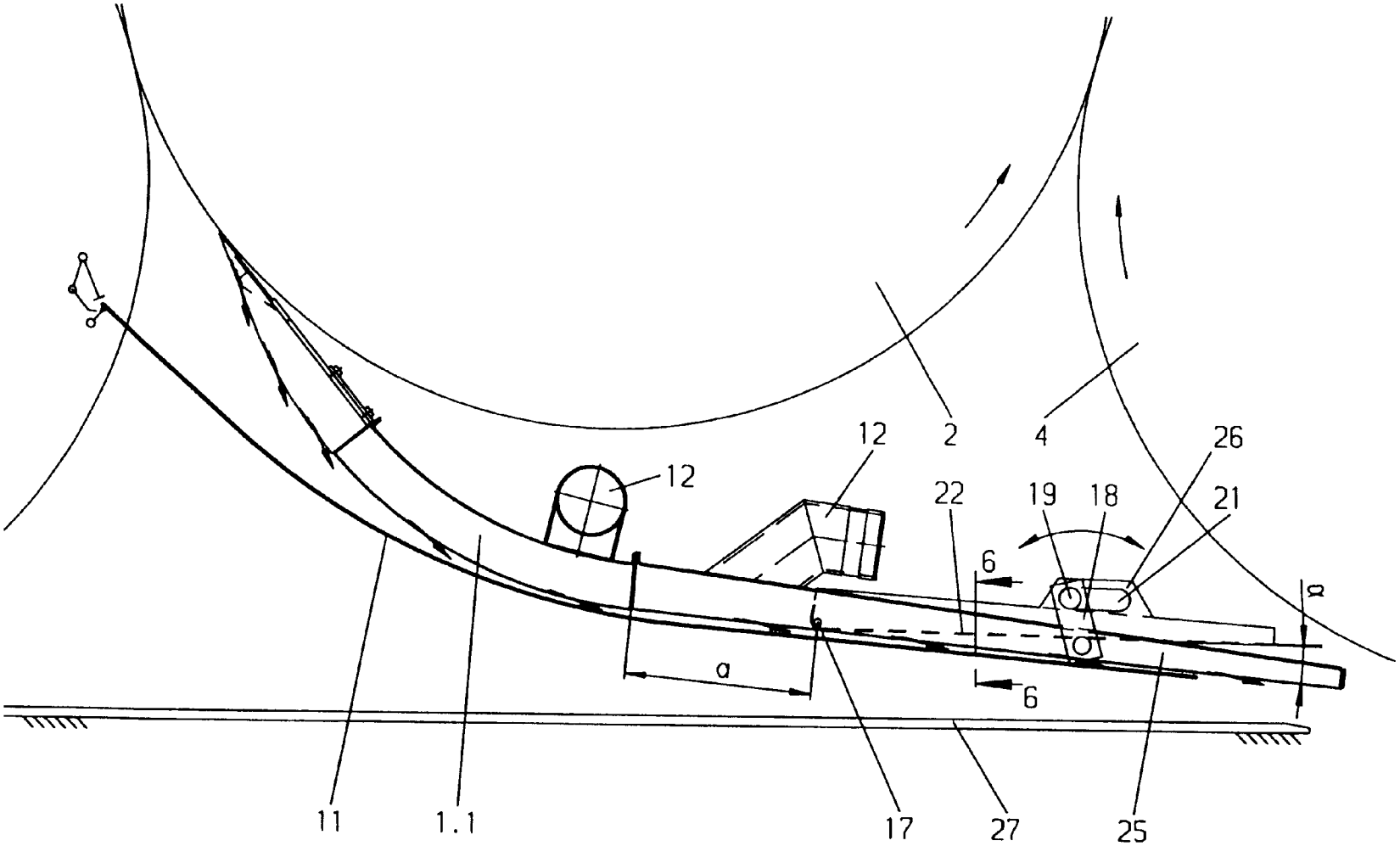
FIG. 5 is an enlarged side elevational view of a second embodiment of the guide blade.
Figure 7:
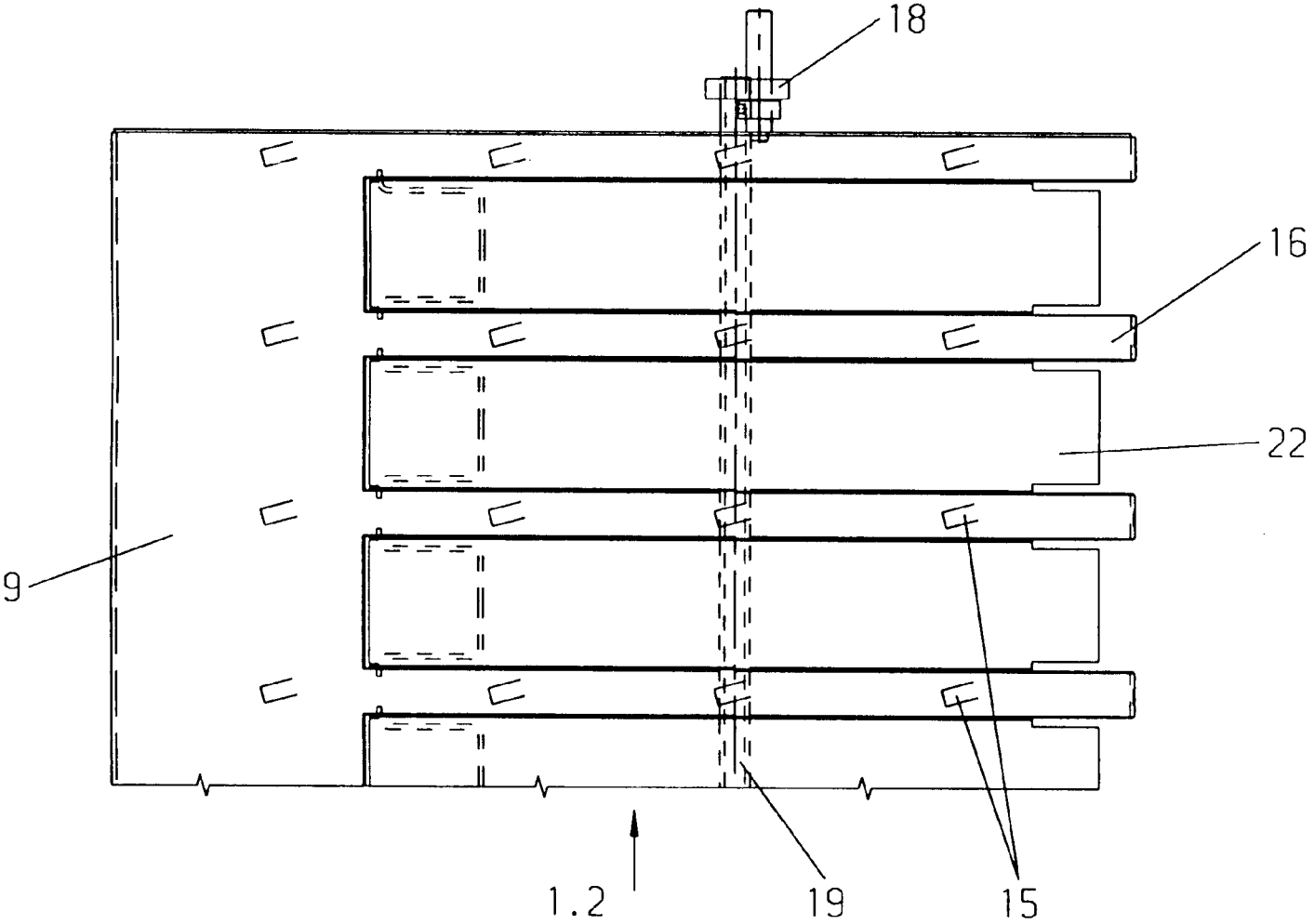
FIG. 7 is a top elevational view of the end piece of the guide blade of FIG. 5.

Referring to FIGS. 5 to 7, in a second embodiment of the invention, the end piece 1.2 is formed in part by the lower sheet metal plate 9 and the upper sheet metal plate 10 lower. Parallel spaced guiding fins 16 with slot nozzles 15 (each having a small outlet angle) are provided at a distance a from the end of the guide blade tip 1.1. The guide fins 16 are pivotally connected to the upper or lower sheet metal plates 9, 10 by a pivot 17.

The guide fins 16 form a flow area 22 which can be adjusted by rotating the guide fins 16 about the pivot point 17. The flow area 22 forms a closed area between the guiding fins 16. A lock-type bracket 18 is mounted on both outer guiding fins 16 and is connected to the adjusting rod 19 (see also FIG. 7). The adjusting rod is guided in an oblong hole 21 of a guide 26 mounted on the end piece 1.2 of the guide 1. The distance between the bottom surface of the guiding fin 16 and the lower sheet metal plate 9 increases from pivot point 17 to the end of the end piece 1.2, thus creating, in connection with the sheet 11, a diverging flow channel 25 with the angle $\alpha$. This angle $\alpha$ can be adjusted with the adjusting rod 19 in the oblong hole 21. In another embodiment (not shown) the flow area 22 can be controlled by the cycle of the sheet sequence around the pivot point 17.

Figure 8:
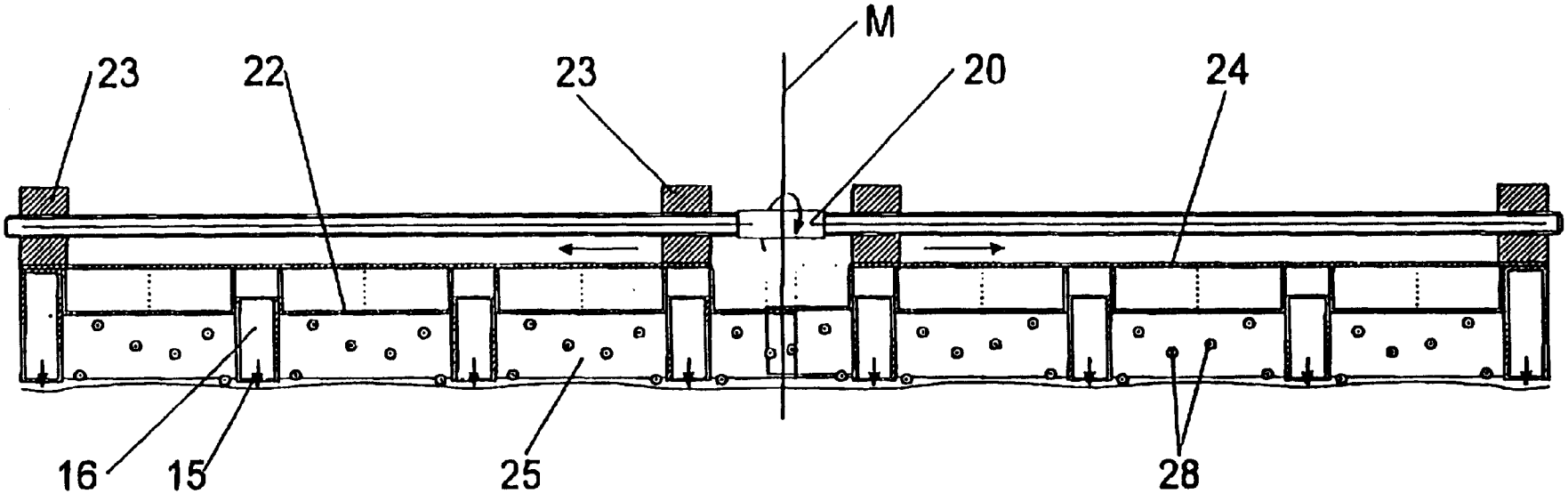
FIG. 8 is a cross-sectional elevation view of the guide fin width adjustment mechanism of the guide blade of FIG. 5.

Refering to FIG. 8, the lateral positioning of the guide fins can be adjusted to accomodate sheets having different widths. The guide blade I has two sets of guiding fins—one set on the right side of the centerline M, and another set on the left side of the centerline M. The guiding fins 16 of each set are connected to one another by a transverse bridge 24. The guiding fins 16 located at the center and at the left and right sides of the centerline M each have a threaded block 23 mounted to the transverse bridge 24 connecting the respective guiding fins 16. A lead screw 20 with left-handed or right-handed thread is threaded through the blocks 23. Thus, when the screw 20 is rotated, the left and right sets of guiding blades 16 move either together or apart, thereby providing adjustment for sheets of varrying widths.

The method of the present invention and the perfecting equipment is described as follows. In in-line mode, the sheet 11 is attached to the impression cylinder 2 in the known manner. After the leading front edge of the sheet passes the tangential point $t_{2,3}$of impression cylinder 2 and perfecting drum 3, the rear range of the sheet 11 is picked up by the sucker system 5, and guided underneath the periphery of the perfecting drum 3. The sheet is then transferred to the gripper system 5 and passed to the succeeding impression cylinder (not shown). Thus enabling the perfecting printing.

The sheet 11 is held by its front edge by the gripper 8 of the impression cylinder 2 during sheet travel, which gripper 8 opens before reaching the guide blade tip 1.1. Simultaneously the front edge of the sheet 11 is deflected from the impression cylinder 2 by means (i.e., a sheet rejecter) mounted in this impression cylinder 2. The air blown by the slot nozzles 15 in the direction of sheet travel between the sheet 11 and the lower sheet metal plate 9 supports the sheet based on the partial vacuum created in the flow channel 25 by the flowing air.

As the sheet travels to the end piece 1.2 of the guide blade 1, the sheet covers the area beneath the guiding fins 16 and forms , with the lower sheet metal plate 9 , a flow channel 25. The flow channel 25 has a permanent partial vacuum which is created by the increasing distance between the lower sheet metal plate 9 and the bottom surface of the guiding fins 16 , and the air streaming into this space in the sheet travel direction. The partial vacuum acts on the sheet 11 and draws it against the guiding fins 16 over the entire area in this range of the end piece 1.2 .

According to the embodiment in FIG. 3 and FIG. 4 the air required for the flow channel 25 in the end piece 1.2 is blown through the slot nozzles 15 in the lower sheet metal plate 9 between the lower sheet metal plate 9 and sheet 11.

According to the embodiment in FIG. 5 to FIG. 7 the air blown from the lower sheet metal blade 9 of the guide blade tip 1.1 in the sheet travel direction between sheet 11 and the lower sheet metal plate 9 reaches the end piece 1.2 and can consequently be used in the flow channel 25. The sheet 11 is supported additionally in the end piece 1.2 by the air directed through the slot nozzles 15 of the guiding fins 16. The air directed through the slot nozzles 15 of the guiding fins 16 acts as an air-foil, which serves to prevent or reduce friction between the sheet 11 and the guiding fins 16, thereby providing low resistance as well as flutter-free motion.

The size adjustment guarantees that all sheet sizes are supported in their outer areas by the outer guiding fins 16 and that the side edge are not caught between two neighbored guiding fins 16. The guiding fins 6 can be adjusted by the lead screw 16 so that the respective outer guiding fins 16 are located above the side edges of the sheet 11. The setting device, consisting of the bracket 18, the adjusting rod 19 and the guide 26 having the oblong hole 21, is used for changing the angle $\alpha$ of the flow channel 25. The angle $\alpha$ can be changed by changing the position of the adjusting rod 19 in the oblong hole 21. according to the desired angle $\alpha$ after loosening the clamping of the bracket 18 at the guiding fin 16.

The invention is based on the finding that, air streaming in the divergent flow channel formed by the lower sheet metal plate 9 and the guiding fins 16 creates a permanent parital vacuum or negative pressure in the flow channel 25, which is acts on the sheet 11 to prevent fluttering.

What is claimed is:

1. A guide blade for guiding sheets in a printing machine, the guide blade comprising:

a front edge portion and an end piece, a flow surface extending from said front edge portion and along said end piece, air nozzels located on said flow surface, said air nozzels being connected to a source of pressurized gas, and said air nozzels directing said pressurized gas in a direction of travel of said sheets, and a plurality of parallel, spaced-apart, guiding fins projecting downwardly from said flow surface and extending along a substantial length of said flow surface, said guiding fins having a downstream end spaced further away from said flow surface than an upstream end thereof;

whereby when said sheet is directed over said guide blade, said sheet, along with said guiding fins and said flow surface, create a diverging flow channel, inducing a partial vacuum in said flow channel which serves to maintain said sheet in contact with said guide blade.

2. The guide blade of claim 1, wherein said front edge and said flow surface comprise a sheet metal plate.

3. The guide blade of claim 1, further comprising air nozzles located in said guiding fins.

4. The guide blade of claim 1, wherein the distance between the guiding fins and the flow surface increases continuously in the direction of the flow of pressurized gas.

5. The guide blade of claim 1, further comprising means to change an angle $\alpha$, defined by the guiding fins and the flow surface.

6. The guide blade of claim 5, wherein the guiding fins are pivotally connected to the end piece of the guide blade.

7. The guide blade of claim 6, wherein said end piece includes a guide having an oblong hole through which an adjustment rod is directed, and further comprising a bracket connected to said guiding fins and said adjustment rod, an angular position of said guiding fins being adjustable by changing a position of the adjustment rod in the oblong hole of said guide.

8. The guide blade of claim 1, further comprising means to adjust the lateral width covered by the guiding fins.

9. The guide blade of claim 8, wherein said lateral width adjustment means further comprises threaded blocks connected to said guiding fins and a threaded screw directed through said blocks.

* * * * *